US008684027B2

(12) United States Patent
Yang

(10) Patent No.: US 8,684,027 B2
(45) Date of Patent: Apr. 1, 2014

(54) PROTECTIVE COVER FOR WALL-MOUNTED FAUCET

(76) Inventor: Tsai-Chen Yang, Taichung (TW)

( * ) Notice: Subject to any disclaimer, the term of this patent is extended or adjusted under 35 U.S.C. 154(b) by 691 days.

(21) Appl. No.: 12/965,534

(22) Filed: Dec. 10, 2010

(65) Prior Publication Data

US 2012/0145258 A1 Jun. 14, 2012

(51) Int. Cl.
*E03C 1/042* (2006.01)

(52) U.S. Cl.
USPC ..... 137/359; 137/315.01; 137/315.12; 137/360

(58) Field of Classification Search
CPC ..... E03C 1/0401; E03C 1/0408; E03C 1/042; E03C 2201/50
USPC ..... 137/315.01, 315.11, 315.12, 315.13, 137/359, 360, 377, 382; 52/34, 35; 285/45, 285/46, 64; 248/56, 65
See application file for complete search history.

(56) References Cited

U.S. PATENT DOCUMENTS 4,896,381 A * 1/1990 Hutto ..... 4/695
5,031,658 A * 7/1991 Brattoli ..... 137/377
5,497,584 A * 3/1996 Bergmann ..... 52/34
5,893,480 A * 4/1999 Dore et al. ..... 220/784
6,893,061 B2 * 5/2005 Miller et al. ..... 292/303
7,191,794 B2 * 3/2007 Hodges ..... 137/360
2006/0231140 A1 * 10/2006 McNerney ..... 137/360

FOREIGN PATENT DOCUMENTS

TW 448997 8/2001

* cited by examiner

*Primary Examiner* — John Fox
*Assistant Examiner* — Kevin Murphy
(74) *Attorney, Agent, or Firm* — Muncy, Geissler, Olds & Lowe, P.C.

(57) ABSTRACT

A protective cover of the present invention is adapted to be disposed on a wall-mounted faucet. The protective cover includes a cover plate. Two protruding posts, two abutting posts, and two extension posts vertically extend from one surface of the cover plate. Each distal end of the protruding posts is formed with a location hole. Each distal end of the extension posts is formed with a hook portion. Therefore, the protruding posts and the abutting posts can abut against the wall-mounted faucet so as to make the location hole receive the location shafts of the faucet and make the hook portions abut against the faucet. Thereby, the present invention can be firmly disposed on wall-mounted faucets to provide a protective effect.

8 Claims, 3 Drawing Sheets

PROTECTIVE COVER FOR WALL-MOUNTED FAUCET

BACKGROUND OF THE INVENTION

1. Field of the Invention

The present invention relates to a protective cover for a wall-mounted faucet.

2. Description of the Prior Art

A conventional protective cover, as shown in TW448997, is used for being disposed on a wall-mounted faucet. Said protective cover can protect the faucet from being hit by tools or stained by paint or the like when said faucet is under construction. However, the protective cover often fails to be firmly fixed on the faucet. Said protective cover loses its function if it falls off during the construction period. Moreover, the faucet after years of use may need to be repaired or dismantled. In this situation, the protective cover fixed on the faucet is a trouble for repairing or dismantling.

The present invention is, therefore, arisen to obviate or at least mitigate the above mentioned disadvantages.

SUMMARY OF THE INVENTION

The main object of the present invention is to provide a protective cover which can be firmly disposed on a faucet and serve as protection.

Another object of the present invention is to provide a protective cover which can be detached selectively by a user.

To achieve the above and other objects, a protective cover for a wall-mounted faucet of the present invention is used for being fixed on a wall-mounted faucet. The wall-mounted faucet includes two location shafts and two location plates. The protective cover for a wall-mounted faucet includes a cover plate.

The plate has a first surface and a second surface. A center of the cover plate is formed with an opening. Two protruding posts, two abutting posts and two extension posts vertically extend from the second surface of the cover plate. Each distal end of the protruding posts is respectively formed with a location hole. The location holes respectively extend parallel with the protruding posts. The protruding posts are used for receiving the location shafts in the location holes. Each distal end of the abutting posts is used for abutting against one of the location plates. Each distal end of the extension posts is formed with a hook portion. Each of the hook portions is used for abutting against one of the location plates so as to position each of the location plates between one of the hook portions and one of the abutting posts.

Thereby, the protective cover of the present invention is adapted to be disposed and fixed on a wall-mounted faucet. Those protruding posts, abutting posts, extension posts, and hook portions can abut against the wall-mounted faucet so that the protective cover can be firmly fixed. Besides, a user can detach the protective cover from the faucet by pulling the hook portions to be disengaged from the location plates.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figures 1, 1A:
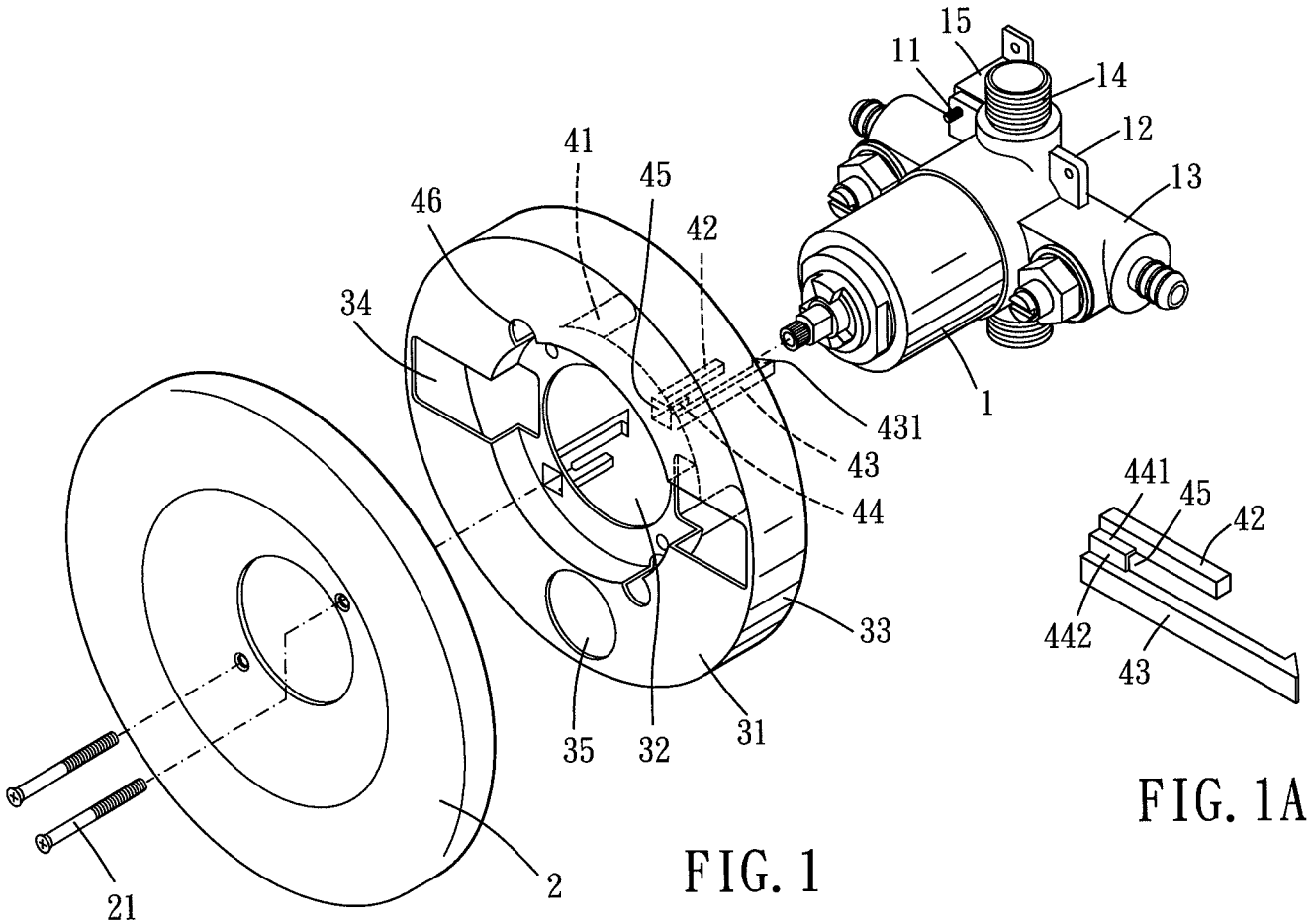
FIG. 1 is a perspective view in accordance with a preferred embodiment of the present invention.
FIG. 1A is an enlarged view in accordance with a reinforcement rib of a preferred embodiment of the present invention.
Figure 2:
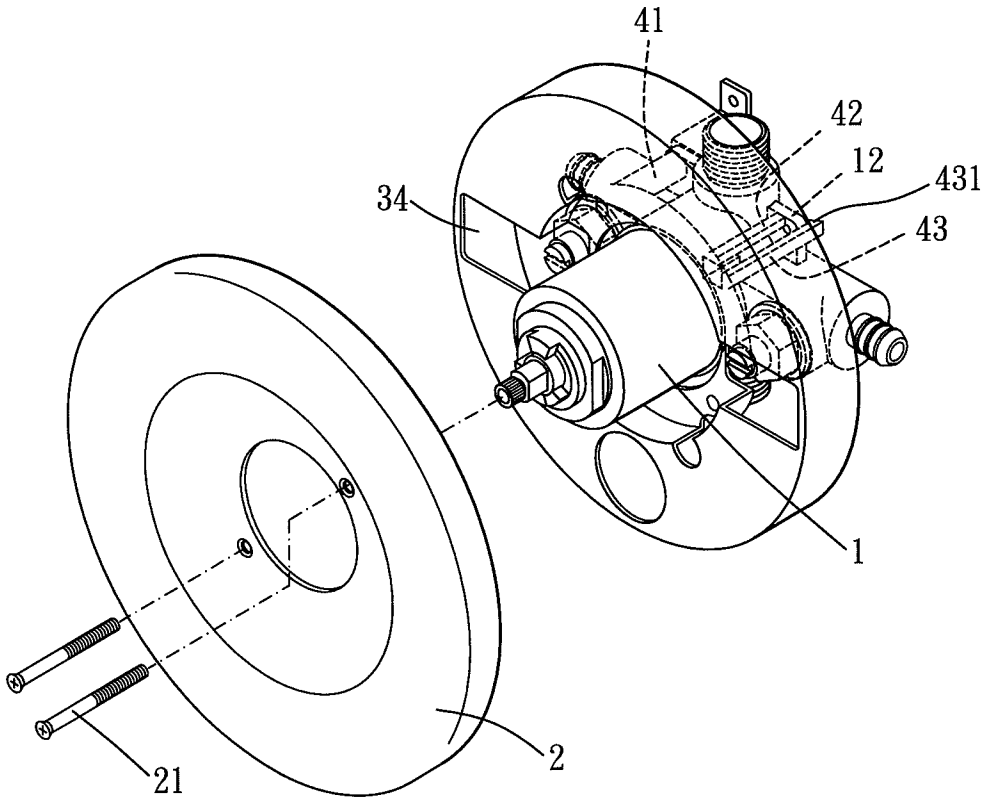
FIG. 2 is a stereogram in accordance with a preferred embodiment of the present invention, wherein said embodiment is fixed on a wall-mounted faucet.
Figure 3:
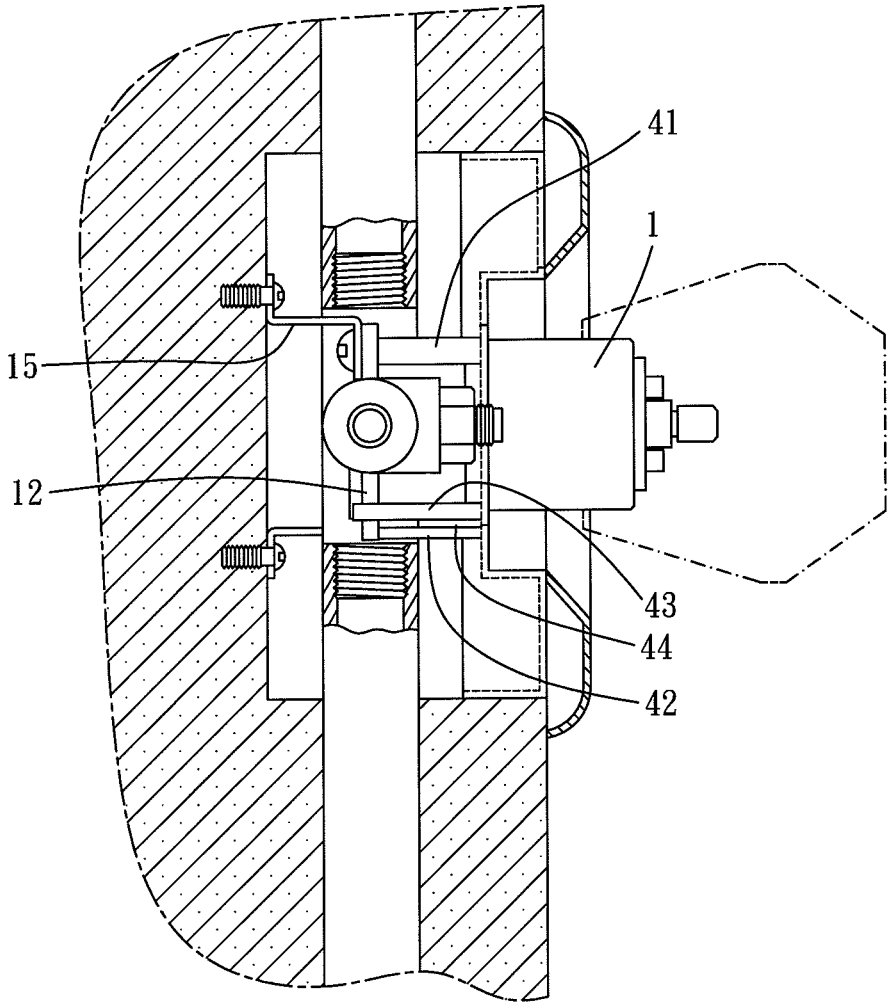
FIG. 3 is a schematic view in accordance with a preferred embodiment of the present invention, wherein said embodiment is in use.

Please refer to FIG. 1 to FIG. 3, a protective cover of the present invention is adapted to be disposed on a wall-mounted faucet 1 and to protect the wall-mounted faucet 1 when said faucet or the wall near it is under construction. Moreover, the protective cover can be directly disposed with a decorative cover 2 after construction. The wall-mounted faucet 1 includes two location shafts 11 and two location plates 12. Specifically, the wall-mounted faucet 1 comprises two horizontal pipes 13 and two vertical pipes 14. Those pipes communicate with each others. A location plate 12 is located at a connection between one of the horizontal pipes 13 and one of the vertical pipes 14, so that there are four location plates 12 on said wall-mounted faucet 1. Two adaptors 15 are respectively screwed into two of the location plates 12 with two screws. The screws protrude from the location plates 12 and serve as the location shafts 11. In other possible embodiments of the present invention, two location shafts can be convexly and integrally formed on the wall-mounted faucet.

The protective cover includes a cover plate. The cover plate has a first surface 31 and a second surface 31 which is opposite to the first one. An opening 32 is formed in a center of the cover plate. Preferably, a periphery of the opening 32 extends toward the second surface and forms an annular recess. A periphery of the cover plate vertically extends from the second surface and forms as an annular side panel 33. Two sides of the opening 32 are respectively formed with an adjustment hole 34 which is used for tools to penetrate therethrough. The cover plate can be further formed with a circular hole 35 which is used for adjusting the vertical pipes 14 or other pipes with tools.

Two protruding posts 41, two abutting posts 42 and two extension posts 43 extend vertically from the second surface of the cover plate. Preferably, the cover plate is further formed with two reinforcement ribs 44, two shield holes 45 and two detachment holes 46.

Each distal end of the protruding posts 41 is formed with a location hole. The location holes respectively extend parallel with the protruding posts 41 so as to receive the location shafts 11 of the wall-mounted faucet 1 into the location holes. Preferably, the protruding posts 41 are located at two sides of the opening 32. Each distal end of the abutting posts abut against one of the location plates 12. Preferably, the abutting posts 42 are located at two sides of the opening 32. The abutting posts 42 and the protruding posts 41 are annularly arranged at the periphery of the opening 32. Each distal end of the extension posts 43 is formed with a hook portion 431. Each of the hook portions 431 can abut against one of the location plates 12 so as to position the location plate 12 between one of the hook portions 431 and one of the abutting posts 42. Preferably, the extension posts 43 are also located at two sides of the opening 32 and are adjacent to the abutting posts 42, so that those abutting posts 42 and those extension posts 43 can be divided into two groups. Therefore, they and the protruding posts 41 can jointly abut against a periphery of the wall-mounted faucet 1.

The shield holes 45 are located at two sides of the opening 32. One of the abutting posts 42 and one of the extension posts 43 are located at a periphery of the shield holes 45. The reinforcement ribs 44 extend vertically from the second surface. The reinforcement ribs 44 are respectively located at the periphery of the shield holes 45, and said ribs 44 respectively connect one of the abutting posts 42 to one of the extension posts 43. Preferably, each of the reinforcement ribs includes a first connection plate 441 and a second connection plate 442. The first connection plate 441 is vertically connected with the second connection plate 442 as shown in FIG. 1A. Thereby, the structural strength of the reinforcement ribs 44 is improved. The first connection plate 441 is connected to the abutting post 42, and the second connection plate 442 is connected to the extension post 43. The detachment holes 46 are located at two sides of the opening 32. The detachment holes 46 and the shield holes 45 are annularly arranged at the periphery of the opening 32. The detachment holes 46 are adapted to be penetrated by tools for installing or dismantling the wall-mounted faucet 1.

Thereby, the present invention is adapted to be disposed on a wall-mounted faucet 1. The protruding posts 41 and the abutting posts 42 can abut against the periphery of the said faucet 1. The hook portions 431 can abut against the location plate 12, and the location holes can receive the location shafts 11 at the same time. Consequently, the present invention can be firmly disposed on the wall-mounted faucet 1, and the decorative plate 2 can be screwed into the location plate 12 through the shield holes 45 with screws 21.

Correspondingly, when a user wants to detach the present invention, the user can put tools into the shield holes 45 and laterally pull the extension posts 43 so as to disengage the hook portions 431 from the location plate 12. In this way, the invention is detached from the wall-mounted faucet 1. Preferably, the length of each of the reinforcement ribs 44 is not greater than a half of the length of each of the extension posts 43, so that the extension posts 43 are easy to be pulled laterally.

Accordingly, the present invention can be firmly disposed on a wall-mounted faucet, and protect said faucet when it or the wall near it is under construction. Moreover, the invention can be detached easily when a user wants to repair the faucet.

What is claimed is:

1. A protective cover for a wall-mounted faucet, the wall-mounted faucet comprising two location shafts and two location plates, the wall-mounted faucet comprising at least one pipe and at least one adjustment portion arranged to the at least one pipe, the two location shafts protrude from the two location plates, the protective cover comprising:

a cover plate, having a first surface and a second surface, an opening formed in a center of the cover plate, two protruding posts, two abutting posts and two extension posts extending vertically from the second surface of the cover plate, each distal end of the protruding posts formed with a location hole, the location holes respectively extending parallel with the protruding posts, the protruding posts adapted to receive the location shafts in the location holes, each distal end of the abutting posts adapted to abut against one of the location plates, each distal end of the extension posts formed with a hook portion, each of the hook portions adapted to abut against one of the location plates so as to position each of the location plates between one of the hook portions and one of the abutting posts;

wherein the two location shafts protrude toward the second surface; wherein the location hole is open toward the location shaft so as to receive and position the location shaft;

wherein the cover plate is provided, on the first surface, with an outer circumferential annular portion, an inner circumferential annular recess portion around the opening and at least one adjustment hole penetrating therethrough, the at least one adjustment hole radially extends on the outer circumferential annular portion and the inner circumferential annular recess portion, and the at least one adjustment portion extends to within the inner circumferential annular recess portion via the at least one adjustment hole.

2. The protective cover of claim 1, wherein the cover plate is further formed with two shield holes, the abutting posts are respectively located at a periphery of the shield holes, and the extension posts are respectively located at the periphery of the shield holes.

3. The protective cover of claim 2, wherein two reinforcement ribs extend vertically from the second surface of the cover plate, the reinforcement ribs are respectively located at the periphery of the shield holes, and each of the reinforcement ribs connects one of the abutting posts to one of the extension posts.

4. The protective cover of claim 3, wherein each of the reinforcement ribs comprises a first connection plate and a second connection plate, the first connection plate is vertically connected with the second connection plate, the first connection plate is connected to one of the abutting posts, and the second connection plate is connected to one of the extension posts.

5. The protective cover of claim 3, wherein a length of each of the reinforcement ribs is not greater than a half length of each of the extension posts.

6. The protective cover of claim 4, wherein a length of each of the reinforcement ribs is not greater than a half length of each of the extension posts.

7. The protective cover of claim 2, wherein the cover plate is further formed with two detachment holes, the detachment holes and the shield holes are annularly alternatively arranged at a periphery of the opening, the shield holes are located at two radially opposite sides of the opening, and the detachment holes are located at another two radially opposite sides of the opening.

8. The protective cover of claim 1, wherein the protruding posts and the abutting posts are annularly alternatively arranged at a periphery of the opening, the protruding posts are located at two radially opposite sides of the opening, and the abutting posts are located at another two radially opposite sides of the opening.

* * * * *